US011060277B2

(12) United States Patent
Hoppe et al.

(10) Patent No.: US 11,060,277 B2
(45) Date of Patent: Jul. 13, 2021

(54) SOUND ABSORBER ARRANGEMENT AND SOUND-INSULATED ROOM

(71) Applicant: LIAVER GMBH & CO. KG, Ilmenau (DE)

(72) Inventors: Christian Hoppe, Erfurt (DE); Ronald Tschiersch, Stuetzerbach (DE)

(73) Assignee: LIAVER GMBH & CO.KG, Ilmenau (DE)

( * ) Notice: Subject to any disclaimer, the term of this patent is extended or adjusted under 35 U.S.C. 154(b) by 112 days.

(21) Appl. No.: 16/301,242

(22) PCT Filed: May 12, 2017

(86) PCT No.: PCT/EP2017/061524
§ 371 (c)(1),
(2) Date: Nov. 13, 2018

(87) PCT Pub. No.: WO2017/194767
PCT Pub. Date: Nov. 16, 2017

(65) Prior Publication Data

US 2020/0318344 A1 Oct. 8, 2020

(30) Foreign Application Priority Data

May 13, 2016 (DE) ..... 10 2016 108 945.1

(51) Int. Cl.
*E04B 1/84* (2006.01)
*E04B 1/82* (2006.01)
(Continued)

(52) U.S. Cl.
CPC ..... *E04B 1/84* (2013.01); *E04B 1/8209* (2013.01); *E04B 9/001* (2013.01); *G10K 11/162* (2013.01)

(58) Field of Classification Search
CPC ..... E04B 1/84; E04B 1/8209; E04B 9/001
See application file for complete search history.

(56) References Cited

U.S. PATENT DOCUMENTS 3,683,100 A * 8/1972 Deal ..... H02G 3/00 174/491
4,605,088 A * 8/1986 Sickels ..... E04B 1/99 181/290

(Continued)

FOREIGN PATENT DOCUMENTS

DE 200 22 685 U1 2/2002
DE 10 2011 105 608 A1 12/2012

(Continued)

OTHER PUBLICATIONS

English translation of International Search Report dated Jul. 13, 2017, issued in connection with corresponding International Application No. PCT/EP2017/061524 (3 pages total).

(Continued)

*Primary Examiner* — Adriana Figueroa
(74) *Attorney, Agent, or Firm* — Mayer & Williams; Stuart Mayer

(57) ABSTRACT

The present invention relates to a sound absorber arrangement comprising multiple sound absorber elements that are arranged in a room having walls and a ceiling that closes off the room at the top. Multiple adjacently situated sound absorber elements form one or more absorber strips that extend(s), at least in sections, along an upper abutting edge extending between the wall and ceiling of the room. The sound absorber elements have a width of 200-400 mm and a thickness of 40-65 mm. The sound absorber elements have a length-specific flow resistance in the range of 5-20 kPa*s/$m^4$.

The invention further relates to a sound-insulated room having such a sound absorber arrangement.

20 Claims, 3 Drawing Sheets

(51) Int. Cl.
*E04B 9/00* (2006.01)
*G10K 11/162* (2006.01)

(56) References Cited

U.S. PATENT DOCUMENTS

| | | | | | |
|---|---|---|---|---|---|
| 4,832,147 | A * | 5/1989 | Dear | E04B 1/8209 | 181/286 |
| 5,536,345 | A * | 7/1996 | Lingart | B44C 5/0407 | 156/89.24 |
| 5,579,614 | A * | 12/1996 | Dorn | E04B 1/84 | 181/284 |
| 5,658,656 | A * | 8/1997 | Whitney | E04B 1/8218 | 181/198 |
| 5,992,561 | A * | 11/1999 | Holben | E04B 1/84 | 181/295 |
| 6,098,743 | A * | 8/2000 | McGrath | B32B 5/26 | 181/150 |
| 8,387,747 | B2 * | 3/2013 | Koike | G10K 11/162 | 181/290 |
| 8,967,823 | B2 * | 3/2015 | D'Antonio | E04B 1/84 | 362/147 |
| 9,140,004 | B2 * | 9/2015 | Hansen | E04B 1/84 | |
| 9,322,165 | B2 * | 4/2016 | Luhtala | E04B 1/84 | |
| 9,683,366 | B2 * | 6/2017 | Gen | G10K 11/168 | |
| 9,691,370 | B1 * | 6/2017 | Stone | G10K 11/168 | |
| 10,017,938 | B2 | 7/2018 | Moennig et al. | | |
| 10,280,614 | B2 * | 5/2019 | Gen | E04B 1/8209 | |
| 2014/0262607 | A1 * | 9/2014 | Gray | E04B 1/84 | 181/290 |

FOREIGN PATENT DOCUMENTS

| | | | | |
|---|---|---|---|---|
| DE | 10 2015 109 808 | A1 | | 12/2016 |
| EP | 2 868 826 | A1 | | 5/2015 |
| JP | 60-75509 | | | 4/1985 |
| JP | 07217980 | A | * | 8/1995 |
| JP | 2001020546 | A | * | 1/2001 |
| WO | 95/30804 | | | 11/1995 |

OTHER PUBLICATIONS

English translation of International Preliminary Report on Patentability dated Nov. 13, 2018, issued in connection with corresponding International Application No. PCT/EP2017 /061524 (8 pages total).

Abe Akustik: "Akustik-Stuck "modern"", Dec. 31, 2011 (Dec. 31, 2011), pp. 1-2, XP055386658, Retrieved from the Internet: URL: http://www.abc-akustik.de/files/produktinformation_akustik-stuck_modern.pdf [retrieved on Jun. 29, 2017]—with English language translation (4 pages total).

* cited by examiner

SOUND ABSORBER ARRANGEMENT AND SOUND-INSULATED ROOM

FIELD

The present invention relates to a sound absorber arrangement, a sound-insulated room using sound absorber elements, and sound-absorbing absorber strips made of such elements.

BACKGROUND

Sound-absorbing elements for improving room acoustics, i.e., for better speech intelligibility and for hearing protection, have been known for quite some time. Acoustic ceilings made of gypsum board or fiberboard improve the room acoustics, reduce the reverberation, and convert sound energy into heat. For sound or recording studios, specialized approaches exist, such as corner units as bass absorbers with elongated slots and nonwoven or foam backings. In addition, acoustic wall paneling is known, for example panels that are mounted on the walls at different angles and in different sizes and used as low-frequency absorbers for absorption of low sound frequencies. For absorption of high sound frequencies, it is common to use perforated panels that are mounted at specified distances from the wall. Sound-deadening and sound-insulating materials such as foams or felts are situated between the panels and the wall.

DE 10 2011 105 608 A1 discloses a sound absorber arrangement designed as an edge absorber for low frequencies. The arrangement includes trough-shaped, preferably cuboidal containers with fibrous or porous absorption material therein having a covering that is permeable or impermeable to sound. The containers are situated in the corners or edges of a room, on the wall or ceiling. The sound absorber arrangement is characterized in that all sides facing the room have a design that is impermeable to sound. Only one oblique side, preferably situated perpendicularly with respect to a wall or the ceiling, has an absorbent design with a fairly small surface area. To achieve the desired effect, the containers that are used must have a minimum size, for which an appropriate localized space must be reserved. One preferred design uses, for example, a homogeneous fibrous absorber 400 mm×500 mm thick, which is situated on the floor in the vicinity of a room edge.

DE 10 2015 109 808 A1 describes a sound-absorbing component, in particular for outdoor areas, comprising a sound-absorbing cover layer and embedded sound absorber elements having a high absorption level compared to the cover layer.

EP 2 868 826 A1 describes a reinforced concrete element, on the surface of which a partially exposed, sound-absorbent, at least partially open-cell foamed material is situated. The reinforcement is partially enclosed by the foamed material. Also disclosed is a ceiling element having multiple absorber strips made of geopolymer. In the application of the concrete element as a ceiling slab, the absorber strips that are used extend in the longitudinal direction, but not in the corner areas between the wall and the ceiling.

Sound absorber elements made of a sintered expanded glass granulate are commercially available, for example those marketed by Liaver GmbH & Co. KG under the trade name Reapor.

A spatial acoustic approach for retrofitting in rooms having a base area of up to 20 $m^2$ is described in a 2011 product specification sheet from ABC Akustik GmbH, Berlin, wherein the oppositely facing sides of the room should be spaced no farther than 5 m apart. For this purpose, absorbers made of open-cell melamine resin-based foam are mounted in the form of a ceiling molding in the upper room edges, between the ceiling and the wall. The absorbers protrude approximately 14 to 35 cm into the room to allow an air space on the rear side, between the absorber and the structural wall. The absorbers must be mounted on the ceiling, using specialized hangers.

Most of the previously known, efficiently operating sound absorber approaches must either be installed from the outset in the rooms to be acoustically improved, or retrofitted with significant effort. This frequently results in a tradeoff between the acoustic effects and the other design aspects of the room from functional, construction engineering, and design standpoints. For example, good acoustic effects may be achieved by covering the entire ceiling with sound absorber panels, but providing air conditioner elements on the ceiling is then no longer possible. Retrofitting sound-insulating ceilings in existing rooms is complicated in terms of construction engineering and also costly, so that this option is rarely used. Providing edge absorbers over a large volume detracts significantly from the esthetics of the room.

SUMMARY

An object of the present invention, therefore, proceeding from the prior art, is to provide an improved sound absorber arrangement, as well as a living, work, or entertainment space that is acoustically enhanced in a preferably broad frequency range. The sound absorber arrangement should occupy minimal volume in the room, be visually unobtrusive, and still achieve considerable improvement in the room acoustics in a broad frequency range. At the same time, the sound absorber arrangement should allow the desired absorption results to be achieved in rooms having a base area >40 $m^2$.

The object is achieved by a sound absorber arrangement according to appended claim 1. The object is further achieved by a sound-insulated room according to claim 5.

A sound absorber arrangement according to the invention includes multiple sound absorber elements that are arranged in a room having walls and a ceiling that closes off the room at the top. Multiple adjacently situated sound absorber elements preferably form one or more absorber strips that extend(s), at least in sections, along an upper abutting edge extending between the wall and ceiling of the room, i.e., in the corner area between the wall and the ceiling. The absorber strip has a width of 200-400 mm, preferably 250-350 mm, particularly preferably 310 mm. The thickness of the absorber strip is 40-65 mm, preferably 50 mm. It is particularly important for the functional capability of the invention that the sound absorber elements have a length-specific flow resistance in the range of 8-10 $kPa*s/m^2$, preferably 8-9 $kPa*s/m^2$. It has surprisingly been shown that flow resistances outside the stated range do not result in the desired absorption, even when the flow resistances in the sound absorber elements vary greatly, and in any case thus lie partially outside the range identified by the invention.

The length-specific flow resistance of the sound absorber elements used according to the invention preferably varies by less than 0.5 $kPa*s/m^2$, preferably less than 0.3 $kPa*s/m^2$, based on the surface area of such an element. This narrow variation of the length-specific flow resistance particularly preferably applies for the entire absorber strip, the length-specific flow resistance in each case being considered for a surface area of the absorber strip <0.5 $m^2$, preferably <0.3 $m^2$, particularly preferably <0.1 $m^2$.

The sound-insulated room according to the invention is used by persons for living, work, or miscellaneous entertainment purposes. The sound-insulated room has at least one absorber strip arranged at an upper edge of the room. It is essential to the invention that multiple sound absorber elements are designed as absorber strips and extend, at least in sections, along the upper edge of the room. The sound absorber elements have the properties stated above with regard to the sound absorber arrangement.

A significant advantage of the sound-insulated room implemented according to the invention is that a particularly high sound absorption level can be achieved by arranging the absorber strip at the upper edge (abutting edge) of the room. This high absorption effect is achieved by the reflections of sound waves that occur in this area, at the wall and also at the ceiling. The sound absorber element designed as absorber strips may be subsequently integrated into existing rooms with little effort, and requires very little installation space. By arranging the absorber strip at the upper edge of the room, there is only minimal restriction of the surface areas and volume available for other uses in the room.

Due to the use according to the invention of sound absorber elements having a length-specific flow resistance in the range of 8-10 kPa*s/m$^2$, preferably 8-9 kPa*s/m$^2$, it is possible for the first time to achieve very efficient sound absorption in a broad frequency range, with only small volumes of the sound-absorbing material and of the space occupied by the sound absorber arrangement. In particular, relatively thin sound absorber elements may be mounted directly on highly acoustically reflective building walls, with no appreciable air space left in between. The building walls reflect the sound waves that have already passed through the sound absorber element once, and diffuse back into the sound absorber element, where further absorption can then take place. For this particularly efficient absorption, it is necessary to set the length-specific flow resistance in the stated range, for example by a suitable selection of the particle size and the material composition of the sound absorber elements used. The sound absorber elements are particularly preferably made of expanded glass granulate having a particle size of 0.25-4 mm, the granulate being sintered in the shape of a board or joined to binder to be added.

The invention is thus based on a combination of the stated composition of the sound absorber elements and their stated arrangement in the room.

According to one particularly preferred embodiment, the absorber strip extends circumferentially at the upper edges of the room. Very good sound absorption is achieved by use of a circumferential absorber strip. If, for example for structural reasons, no circumferential course of the absorber strip is possible, the absorber strip may also be interrupted in areas, in which case good sound insulation can also be achieved.

One advantageous embodiment uses multiple absorber strips. Each absorber strip once again extends at an upper edge of the room, at least in sections. The absorber strips may be designed, for example, in the form of easily handled panels which preferably continuously adjoin one another. However, spaces may also be present between individual absorber strips, if necessary.

The absorber strip is preferably fastened to a wall or a ceiling of the room. The absorber strip extends in each case to the upper abutting edge of the room, i.e., up to the corner that is formed between the wall and the ceiling. The fastening may take place by means of a suitable adhesive, for example. Alternatively, the absorber strip may be fixed to the wall or ceiling with the aid of clamps or other suitable mechanical fastening means. It is also conceivable to use a support profile in which the absorber strip is clamped or fastened in some other way.

According to one advantageous embodiment, the absorber strip is made of an acoustically effective, sound-absorbing, nonductile foam. This is preferably a mineral material that forms a rigid foam. Glass-based, acoustically effective, permeable foam, preferably containing an expanded glass granulate, has proven to be a particularly suitable material for the absorber strip. For this purpose, individual glass particles are joined together by sintering or by a binder, which may have a fiber component. The material used for the absorber strip is advantageously suitable for wet rooms, frost-resistant, flame-retardant, and very lightweight, and is thus usable in a variety of spaces. It may also be easily cut to size.

The length-specific flow resistance of the sound absorber element required according to the invention may be set particularly easily by the grain sizes used, i.e., the particle size distribution in the sound absorber element, preferably having a panel-shaped design, and/or the proportion of binder that is added to the expanded glass granulate during manufacture.

The absorber strip preferably has a width of 250 mm to 500 mm. In addition, a thickness of 25 mm to 60 mm has proven advantageous. An absorber strip designed in this way may be easily integrated, and requires comparatively little installation space.

A particularly satisfactory, unobtrusive integration of the absorber strip may be achieved by recessing the absorber strip into the ceiling or the wall. For this purpose, an appropriate recess is preferably introduced into the wall and ceiling. The absorber strip preferably terminates in flush alignment with the ceiling or the wall. This installation variant is suited in particular for new buildings when the recesses have already been taken into account in the planning phase, or in pending basic renovation operations. The recesses may be provided in reinforced concrete ceilings, masonry walls, or drywall constructions, for example, and then fitted with sound absorber elements.

A base area size between 80 m$^2$ and 130 m$^2$ for a wall height of 2 to 3 m has proven advantageous for the sound-insulated room. In this range, particularly good results with regard to sound absorption may be achieved with the sound-absorbing absorber strip used.

In order to achieve optimal acoustic absorption effects for rooms having a base area much larger than 120 m$^2$, an acoustic division of the room into multiple cells is necessary. This may be achieved by mounting additional sound absorber elements, which preferably have the same properties as the sound absorber elements used in the sound absorber arrangement according to the invention. The additional sound absorber elements are fastened to the ceiling, thus segmenting the room into the stated cells. Alternatively, known acoustic baffles may also be used for this purpose.

With the sound absorber arrangement used according to the invention, reverberation times in the range of 0.6 s to 0.9 s are achievable in equipped rooms, which corresponds to the target value in communication rooms. In non-equipped rooms having walls and ceilings made of reinforced concrete, the reverberation time of 2 to 4 s is reduced to 0.8 to 1.2 s by use of the sound absorber arrangement. The sound absorber arrangement is suited in particular for damping in the frequency range of 250 Hz to 4 kHz.

In one modified embodiment, absorber strips are mounted on the wall and also on the ceiling of the room, and in each case extend to the upper abutting edge of the room, i.e., they abut in the corner area between the wall and the ceiling. Alternatively, corner profiles that are made of absorber strips and mounted directly in the corner area of the room may be used.

In one advantageous embodiment, the surface of the absorber strip facing the room has a structured surface. The structuring may further improve the absorption properties and at the same time may be used for an esthetic design, so that the absorber strip has the appearance of an edging or a cornice.

BRIEF DESCRIPTION OF THE DRAWINGS

Further particulars and advantages of the sound absorber arrangement according to the invention and of the sound-insulated room thus equipped result from the following description of one preferred embodiment, with reference to the drawings, which show the following.

DETAILED DESCRIPTION

Figure 1:
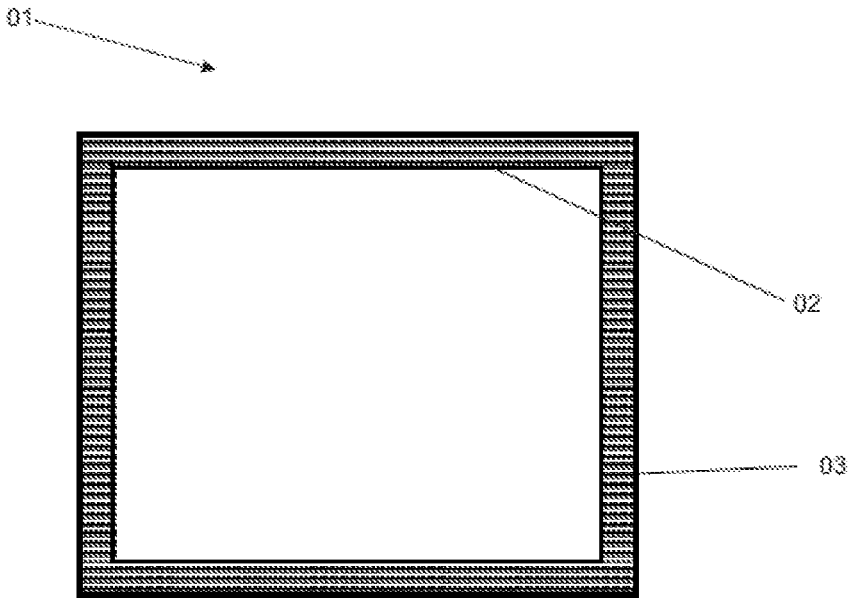
FIG. 1 shows a ceiling soffit, not true to scale, of a sound-insulated room according to the invention.

FIG. 1 shows a ceiling soffit, not true to scale, of a sound-insulated room 01 according to the invention, which represents the upper edge area of the room 01. The base area of the room is preferably 40-130 $m^2$. The room is equipped with a sound absorber arrangement according to the invention. For this purpose, a sound-absorbing absorber strip 03 that extends circumferentially along the abutting edges 02 is arranged at the upper abutting edges 02 of the room 01. The absorber strip 03 may be situated either on the ceiling or on the wall of the room 01, and in each case extends to the corner formed between the wall and the ceiling (abutting edge). There is a strong, preferably full-surface connection between the ceiling and the absorber strip 03 or between the wall and the absorber strip 03, for example in the form of an adhesive connection or a mechanical connection, for example by means of clamps. The wall or ceiling may have a recess for complete or partial accommodation (in the cross section) of the absorber strip 03. The recess is particularly preferably designed in such a way that the absorber strip 03 may be fully introduced, thus terminating in flush alignment with the ceiling or wall.

The absorber strip 03 is made up of one, or preferably multiple, sound absorber element(s) made of a nonductile foam, preferably a glass-based foam with an expanded glass granulate component. This material is well suited for sound insulation, and is easy to process. The sound absorber elements have a length-specific flow resistance in the range of 8-10 kPa*s/$m^2$, preferably 8-9 kPa*s/$m^2$.

The absorber strip preferably has a width between 250 mm and 500 mm and a thickness of 25 mm to 60 mm. The absorber strip 03 preferably has a panel-shaped design. To form a circumferential absorber strip 03, multiple sound absorber elements are continuously lined up in a row without spaces in between. In alternative embodiments, the absorber strips 03 may extend at the upper abutting edges of the room 01 only in sections.

Figure 2:
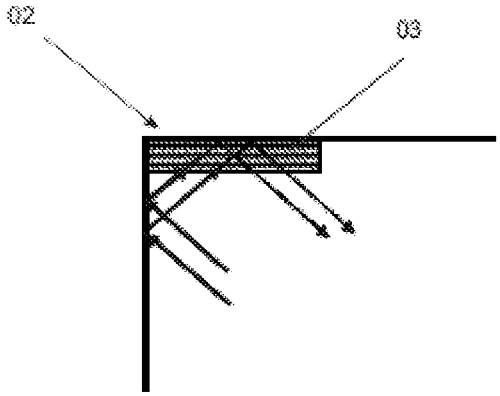
FIG. 2 shows an absorber strip situated at an upper edge of the room according to the invention.

FIG. 2 shows an absorber strip 03 arranged on an upper edge 02 of the room 01 according to the invention. The reflections of diffuse sound waves occurring in this edge area are illustrated in a greatly simplified manner by means of arrows. The incident sound waves are reflected primarily in the region of the upper edge of the room, on the wall and the ceiling, as the result of which a particularly good absorption effect may be achieved by means of absorber strips 03.

Figure 3:
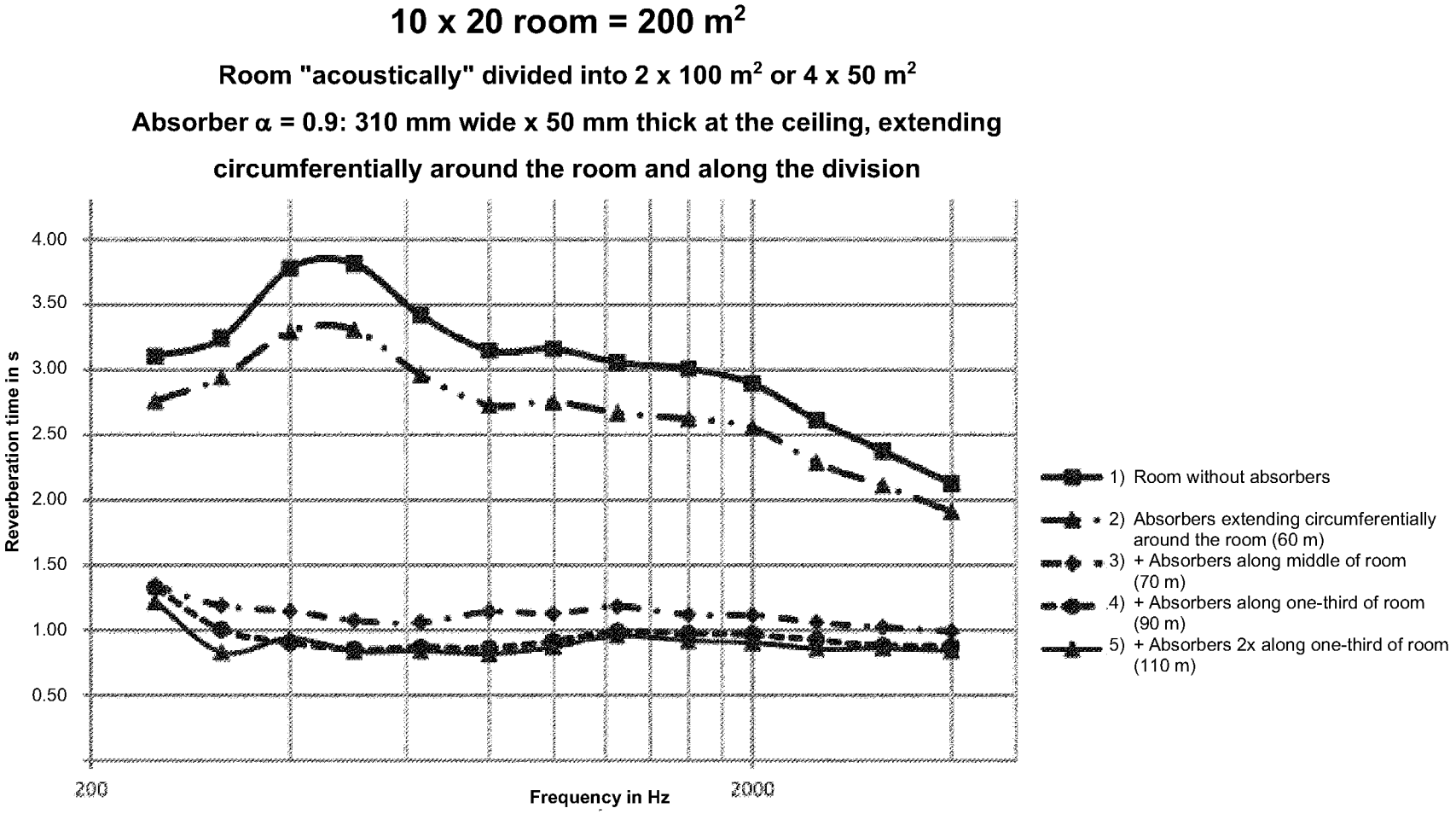
FIG. 3 shows a diagram for illustrating measured values of the reverberation time in differently configured rooms, over a broad frequency range.
Figure 4:
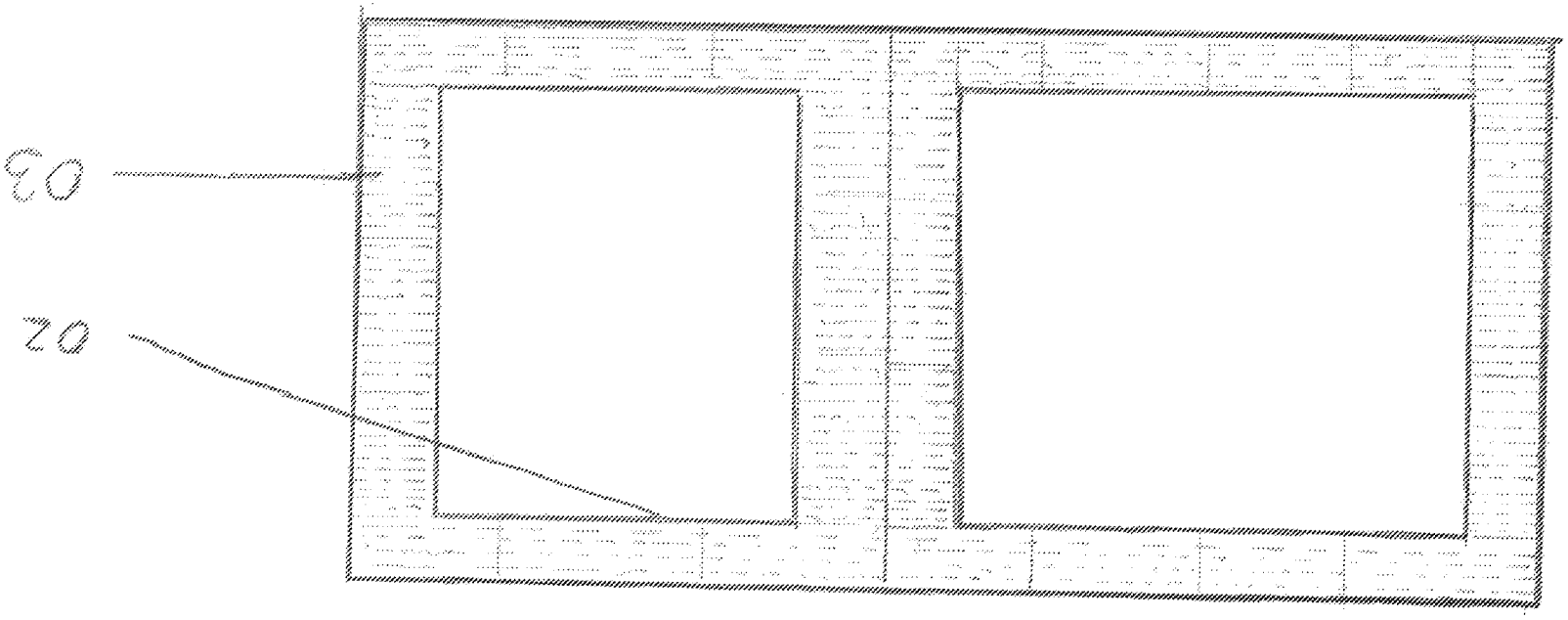
FIG. 4 shows a ceiling soffit, not true to scale, of a sound-insulated room divided into two acoustic cells according to an embodiment of the invention.

FIG. 3 shows a diagram with multiple measured value curves of the reverberation time over a broad frequency range. The individual curves have been recorded in the same room, having a base area of 10×20 m, and the walls and the ceiling are made of standard reinforced concrete.

Curve 1) shows the course of the reverberation time in the original room, i.e., without installation of the sound absorber arrangement.

Curve 2) shows the reverberation time after installation of the absorber strips that are mounted circumferentially in the room, on the ceiling, in each case extending to the upper abutting edge. The reverberation time decreases uniformly by approximately 0.3-0.4 s over all frequencies. This result is not quite satisfactory, and is attributed to the fact that the room has a base area that is much larger than 120 $m^2$.

Curves 3), 4), and 5) show the reverberation times in the room when the room has been divided into acoustic cells of ≤120 $m^2$ each. This division has been carried out in each case by mounting the same sound absorber elements on the ceiling in the interior of the room along straight lines, resulting in a grid with areas of 1×200 $m^2$, 2×100 $m^2$, and 4×50 $m^2$. It is apparent that the reverberation times are drastically reduced by more than 1 s over the entire frequency range. The surprising effect occurs in acoustic room sizes smaller than 100 $m^2$. The acoustic absorption power may even be improved in an under-proportional manner, compared to the described sound absorber arrangement, by multiple installations. The absorber design according to the invention thus shows an optimum in relation to the installed quantity of absorbers and the achieved absorption power.

LIST OF REFERENCE NUMERALS

01—sound-insulated room
02—upper edges
03—absorber strip

The invention claimed is:

1. A sound absorber arrangement comprising multiple sound absorber elements made of expanded glass granulate that are arranged in a room having walls and a ceiling that closes off the room with a size of 40 $m^2$ to 130 $m^2$ at the top, wherein multiple adjacently situated said sound absorber elements form one or more absorber strips that extend, at least in sections, along an upper abutting edge extending between the wall and ceiling of the room;

the sound absorber elements have a width of 200-400 mm and a thickness of 40-65 mm; and the sound absorber elements have a length-specific flow resistance in the range of 8-10 kPa*s/$m^2$.

2. The sound absorber arrangement according to claim 1, wherein the sound absorber elements are made of expanded glass granulate having a particle size of 0.25-4 mm, the granulate being either sintered in the shape of a board or joined to a binder, and the length-specific flow resistance being in the range of 8-9 kPa*s/$m^2$.

3. The sound absorber arrangement according to claim 1, wherein the one or more absorber strips are fastened directly to a fastening surface of the wall or the ceiling of the room without a cavity remaining between the sound absorber elements and the fastening surface.

4. A sound-insulated room with a size of 40 $m^2$ to 130 $m^2$ for living, work, or entertainment purposes, having walls, a ceiling that closes off the walls at the top, and at least one sound absorber arrangement according to claim 1 arranged on a wall or ceiling surface of the room.

5. The sound-insulated room according to claim 4, wherein at least one of the one or more absorber strips of the at least one sound absorber arrangement extends circumferentially at the upper edges of the room.

6. The sound-insulated room according to claim 4, wherein the sound-insulated room includes multiple of the one or more absorber strips, each absorber strip extending, at least in sections, at an upper edge of the room.

7. The sound-insulated room according to claim 4, wherein the room is divided into acoustic cells, each having a base area no greater than 130 $m^2$, this division being created by the sound absorber elements that are fastened to the ceiling.

8. The sound-insulated room according to claim 4, wherein the one or more absorber strips are integrated into the ceiling or wall of the room.

9. A sound-insulating room for living, work, or entertainment purposes, having walls, a ceiling that closes off the walls at the top, and at least one sound absorber arrangement according to claim 2 arranged on a wall or ceiling surface of the room.

10. A sound-insulating room for living, work, or entertainment purposes, having walls, a ceiling that closes off the walls at the top, and at least one sound absorber arrangement according to claim 3 arranged on a wall or ceiling surface of the room.

11. A sound-insulated room according to claim 5, wherein the room is divided into acoustic cells, each having a base area no greater than 130$m^2$, this division being created by the sound absorber elements that are fastened to the ceiling.

12. A sound-insulated room for living, work, or entertainment purposes with walls, a ceiling that closes off at the top of the wall and at least one sound absorber arrangement arranged on a wall or ceiling surface of the room according to claim 1, wherein the room is divided into acoustic cells, each having a base area no greater than 130$m^2$, this division being created by the sound absorber elements that are fastened to the ceiling.

13. The sound-insulated room according to claim 1, wherein the one or more absorber strips are integrated into the ceiling or wall of the room.

14. The sound absorber arrangement according to claim 1, wherein the one or more absorber strips are fastened directly to a fastening surface of the wall or the ceiling of the room without a cavity remaining between the sound absorber elements and the fastening surface.

15. The sound absorber arrangement according to claim 2, wherein the one or more absorber strips are fastened directly to a fastening surface of the wall or the ceiling of the room without a cavity remaining between the sound absorber elements and the fastening surface.

16. The sound absorber arrangement according to claim 3, wherein the one or more absorber strips are adhesively affixed to the fastening surface of the wall or the ceiling of the room.

17. The sound-insulated room according to claim 8, wherein the one or more absorber strips terminates in flush alignment with the ceiling or wall.

18. The sound-insulated room according to claim 13, wherein the one or more absorber strips terminates in flush alignment with the ceiling or wall.

19. The sound absorber arrangement according to claim 14, wherein the one or more absorber strips are adhesively affixed to the fastening surface of the wall or the ceiling of the room.

20. The sound absorber arrangement according to claim 15, wherein the one or more absorber strips are adhesively affixed to the fastening surface of the wall or the ceiling of the room.

* * * * *